US005263208A

United States Patent [19]

Smith

[11] Patent Number: 5,263,208

[45] Date of Patent: Nov. 23, 1993

[54] ALIGNMENT SYSTEM FOR BATHING ENCLOSURE

[75] Inventor: Iain M. Smith, Vernon, Canada

[73] Assignee: Kohler Ltd./Kohler Ltee, Toronto, Canada

[21] Appl. No.: 907,944

[22] Filed: Jul. 2, 1992

[51] Int. Cl.[5] ..... A47K 3/22

[52] U.S. Cl. ..... 4/612; 4/596

[58] Field of Search ..... 4/596, 612, 614, 506, 4/584, 592, 593, 595; 52/34, 35, 281, 461, 465

[56] References Cited

U.S. PATENT DOCUMENTS

| | | | |
|---|---|---|---|
| 1,276,404 | 11/1990 | Schick et al. . | |
| 1,933,857 | 11/1933 | Jones | 4/614 |
| 3,225,362 | 12/1965 | Barrera | 4/506 X |
| 3,382,635 | 5/1968 | O'Gara et al. . | |
| 3,710,401 | 1/1973 | Goettl | 4/506 X |
| 4,177,614 | 12/1979 | Arp | 4/506 X |
| 4,316,295 | 2/1982 | Whitney et al. . | |
| 4,471,501 | 9/1984 | Heymann . | |
| 4,553,276 | 11/1985 | Paradis | 4/596 |
| 4,578,832 | 4/1986 | Primucci . | |
| 4,901,380 | 2/1990 | Smith . | |

FOREIGN PATENT DOCUMENTS

| | | |
|---|---|---|
| 1276404 | 11/1990 | Canada . |
| 2016131 | 9/1991 | Canada . |

*Primary Examiner*—Charles E. Phillips
*Attorney, Agent, or Firm*—Quarles & Brady

[57] ABSTRACT

A knock down type bathing enclosure is disclosed which is manufactured as a one-piece plumbing fixture, cut into two or more portions for transportation, and assembled at an installation site. In addition to having a clamping system to clamp an upper and lower portion together vertically, there is provided a corner web structure which provides for horizontal alignment through the use of a C-shaped clip and aligned ribs.

5 Claims, 3 Drawing Sheets

ALIGNMENT SYSTEM FOR BATHING ENCLOSURE

FIELD OF THE INVENTION

This invention relates to bathing enclosures. More particularly, it pertains to bathing enclosures that can be divided into portions and then subsequently reassembled.

BACKGROUND OF THE INVENTION

The term "bathing enclosure" encompasses a wide variety of types of plumbing fixtures such as bathtubs, showers, whirlpools, spas, saunas, and environmental enclosures. In many modern designs these bathing enclosures are molded from fiberglass or other materials in one-piece. This yields significant production efficiencies and minimizes installation costs.

A disadvantage of one-piece units is their size. There sometimes is not sufficient space to introduce such units into existing buildings. This is a particular problem when it is desired to remodel a bathroom in an old building where the size of the doorways and halls are already fixed. Removing building walls and widening doorways to remodel a bathroom can significantly increase the cost of the project.

Some bathing enclosures are designed so as to be suitable to be cast as a single piece and then cut into two or more pieces. The pieces are then transported through small entranceways and reassembled at installation sites.

One such "knock down" type bathing enclosure is that disclosed in U.S. Pat. No. 4,901,380. That enclosure has a horizontally extending joining strip attached to the outside of the enclosure. The strip adheres to the enclosure outer wall and has an outer tubular bulge. The wall (with joining strip thereon) is cut into two pieces along a horizontal plane that also passes through the tubular bulge. A plurality of locator lugs are then inserted into an internal slot formed in the bulge. Guided into proper alignment by the lugs, the cut portions are then fastened together using clamps.

The 4,901,380 system previously had the horizontally extending joining strips extend around corners of the enclosure. However, as corners on such enclosures became more numerous and more closely spaced (e.g. a corner at the intersection of the side wall with a small frontal frame for the tub opening; a corner near a soap dish recess), use of this system became more difficult.

Thus, it can be seen that a need exists for an improved knock down type bathing enclosure.

SUMMARY OF THE INVENTION

The invention provides a bathing enclosure of the type having a multi-piece plumbing fixture wall structure with a first portion and a second portion. The first portion has walls with edges which can be substantially aligned with opposed edges of walls of the second portion so as to define a generally horizontal seam. Means are provided for restricting vertical movement of the wall portions relative to one another.

The improvement relates to having a first and second web. The webs are on an external side of the wall structure and each has a vertically extending rib and an enlarged vertically extending head on the rib.

One of the webs is affixed to the first wall structure portion and the other of the webs is affixed to the second wall structure portion. The webs are both affixed adjacent the seam such that the ribs and heads are vertically aligned with one another. Together they form a vertically extending alignment bar. A clip is positioned around the outside of both ribs so as to restrict horizontal movement of the heads relative to one another.

In a preferred embodiment, the clip is in the form of a C-shaped tube. The clip has a hollow central section that is suitable to house portions of the aligned heads of the webs, and feet that interfit with necks on the ribs. The lower end of the feet, neck, and/or hollow can be tapered so that the clip widens at the bottom to more readily accept the alignment bar. Preferably, means are provided between the clip and the webs to inhibit downward movement of the C-shaped clip on the webs past a selected point.

The webs may be positioned at a generally flat portion of the enclosure wall, albeit very near a corner of the enclosure. However, they can instead be provided on a curved wall surface (and thus used directly at the corner).

In an especially preferred form, the webs are used in combination with the U.S. Pat. No. 4,901,380 system. Instead of having the U.S. Pat. No. 4,901,380 clamping system extend all the way around the tub, the prior system is only used on very long straight areas of the tub (with breaks there between). The clips and webs are used in these breaks. The combination of the prior clamping system with the webs and clips of the present invention is highly advantageous.

One object of the present invention is therefore to provide a bathing enclosure that can be cut and reassembled without loss of height of the bathing enclosure.

It is another object of the invention to provide a system for reassembling cut portions of a bathing enclosure that permits easy alignment of the upper and lower portions.

It is yet another object of the invention to provide a system of this type which can be used with enclosures having tight corners.

The foregoing and other objects and advantages of the invention will be evident from the following description. In the description, reference should be made to the accompanying drawings which form a part hereof. Such embodiments do not necessarily represent the full scope of the invention. Reference should therefore also be made to the claims herein for interpreting the full scope of the invention.

DESCRIPTION OF THE PREFERRED EMBODIMENTS

Figure 1:
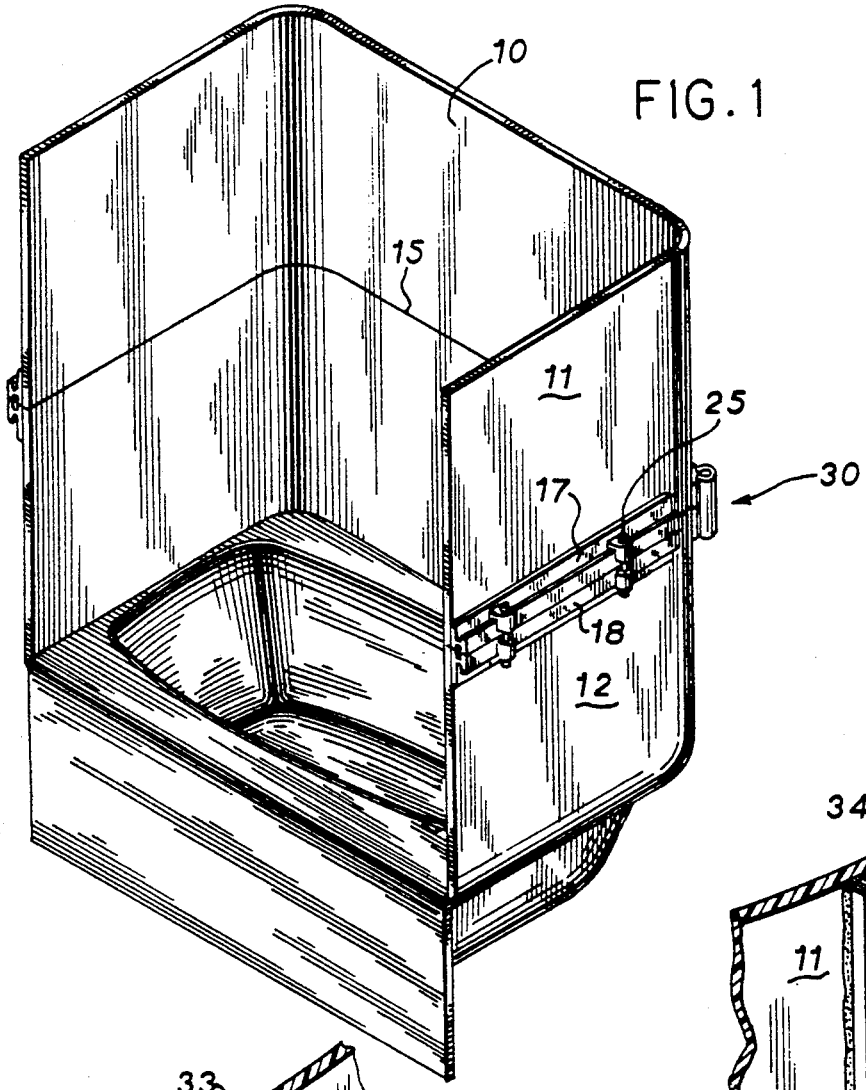
FIG. 1 is a top perspective view of bathing enclosure in accordance with the present invention.

In a preferred embodiment of a present invention there is provided a bathing enclosure 10 which is defined by three side walls, a tub, and an apron. Preferably the walls are an acrylic-faced fiberglass reinforced polyester resin. The enclosure is split into an upper portion 11 and a lower portion 12. Vertical edges 13, 14 of these portions are aligned so as to define a seam 15 that runs substantially horizontally around the tub enclosure.

Figure 2:
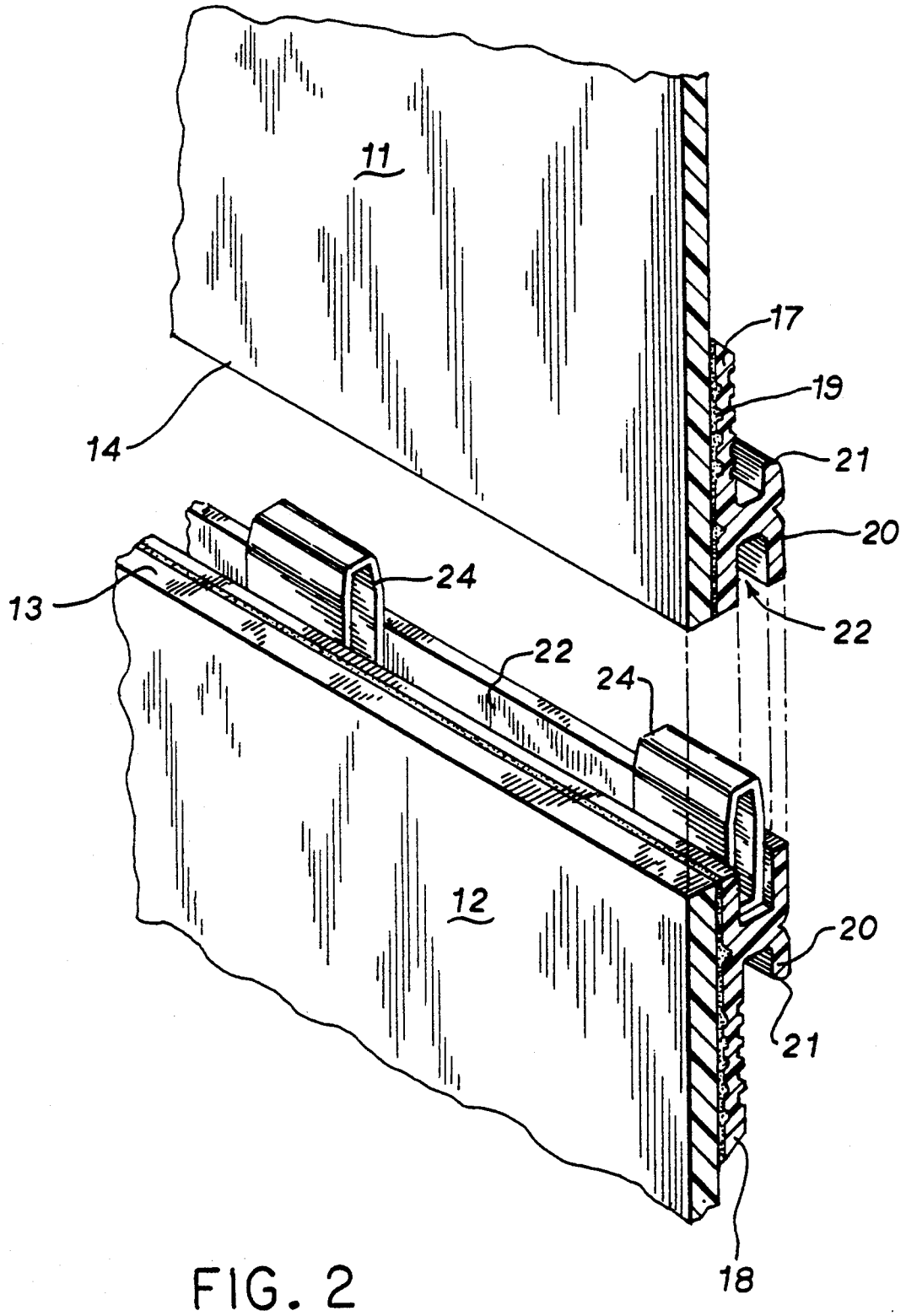
FIG. 2 is an enlarged perspective view taken from the interior of the enclosure of a part of the enclosure that incorporates the U.S. Pat. No. 4,901,380 system.

As best seen in FIG. 2, there is provided a first joining strip 17 and a second joining strip 18. The joining strips are attached on the external side of the wall structures and have inner attachment surfaces 19 for abutment, outer bulges 20, and outer clamp abutment surfaces 21 on the bulges. Slots 22 are formed so as to run along the strips. U.S. Pat. No. 4,901,380 is hereby incorporated by reference as if fully set forth herein. This patent describes in greater detail the FIG. 2 joining strip/locater lug system.

Joining strips 17 and 18 are preferably made of an acrylic-based polymer CYRO-XT375 from Cyro Industries. The precursor of strips 17 and 18 is fixed to the precursor of walls 11 and 12 using an adhesive such as a fiberglass reinforced polyester resin. The wall and joining strip are then each cut into two pieces along seam 15 (which is defined by the cut). The slots 22 face each other and define a tubular inner hollow along the seam.

Locator members 24 are positional inside the hollow so as to assist in alignment. The locator members can be an inch or two in width, or if desired a single locator member can extend for the full length of each slot. Moreover, the locator itself need not be hollow.

As shown in FIG. 1, clamps 25 can fasten together the enclosure portions 11 and 12 by abutting against the clamp abutment surfaces 21. The clamps assist in creating a water tight seal, but if desired a silicone or other sealant can also be used at the seam.

Figure 4:
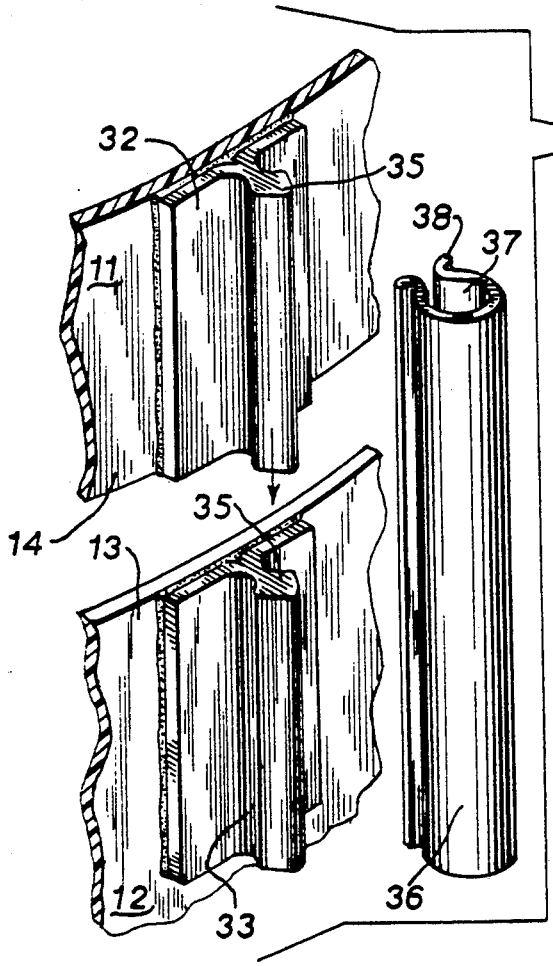
FIG. 4 is a perspective view similar to FIG. 3, except that the web and bathing enclosure have been cut in two and a C-clip has been positioned nearby.

In accordance with the present invention there is also provided a web structure 31. The web is preferably made of CYRO-XT375 and attached to the tub exterior with fiberglass reinforced polyester. After the web has been attached in substantially vertical fashion to a tub enclosure that has been molded as a single piece, and after joining strips 17, 18 have been affixed to each side, the enclosure can be cut in two along a substantially horizontal seam. The web will end up in two pieces 32 and 33 (see FIG. 4). Note also that the web could instead be formed integrally with the enclosure.

Figure 5:
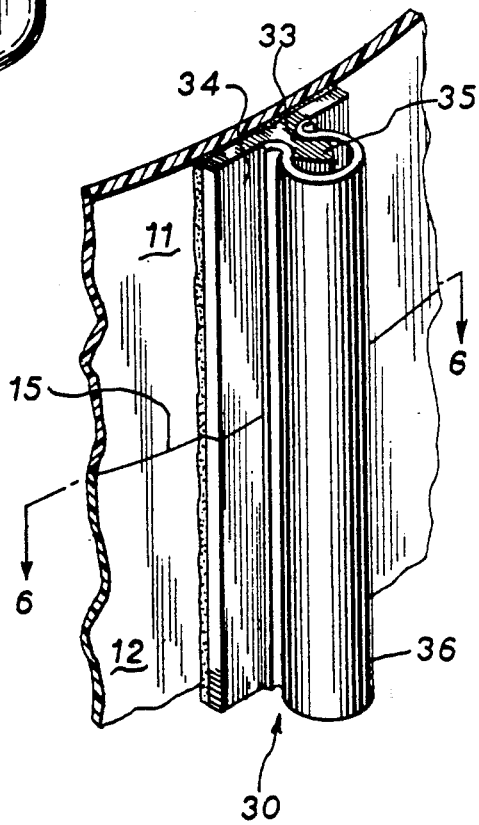
FIG. 5 is a view similar to FIG. 4, but with the C-clip shown assembled on the aligned webs after the bathing enclosure sections have been placed on top of one another. This is a position that can be used for compact shipment of the enclosure, or if a sealant is used represents the installed position.
Figure 3:
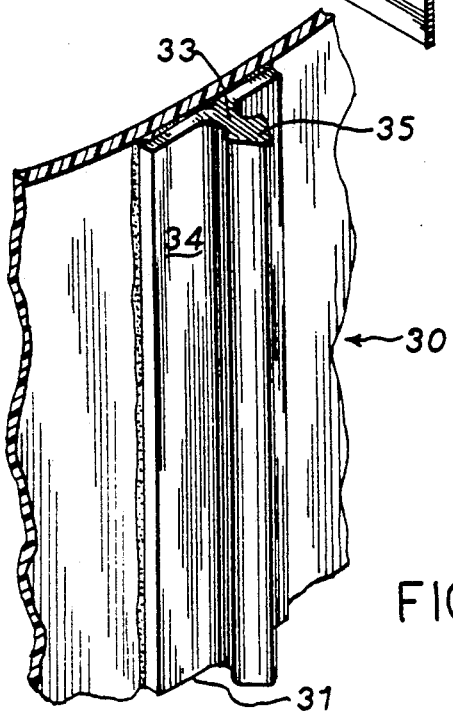
FIG. 3 is a perspective view of the preferred web shown vertically affixed to an outer wall of a bathing enclosure, albeit before the enclosure and web are cut in two.

There is also provided a C-shaped clip 36 which has a central hollow 37 and legs 38. When the tub wall portions 11 and 12 are roughly aligned, corner alignment is improved by sliding the C-clips 36 down over the enlarged heads 35 to the position shown in FIG. 5. This is assisted by thinning out the walls that form the legs, neck and part of the head at the bottom of the clip in the form of a taper.

Figure 6:
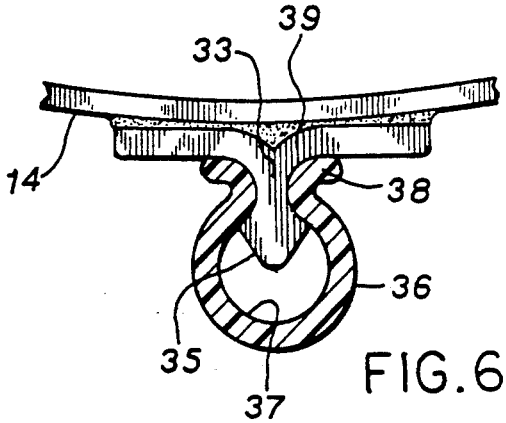
FIG. 6 is a sectional view taken on line 6—6 of FIG. 5.

The material of the clip is strong enough to help drive the walls into exact alignment as it is wedged onto the heads 35 (or tapped down on the heads with a hammer). The rib 33 and the C-clip 36 are configured such that after one no longer holds the clip it will not fall off the ribs. In this regard, as best shown in FIG. 6, there is a very tight fit of legs 38 into neck recesses 39.

If desired, the C-clip hollow 37 can be made more narrow at the top. This will prevent downward movement of the C-clip relative to the web past a selected point.

Note that the C-clip does not need to inhibit vertical movement of the enclosure walls relative to each other. Its purpose is to provide horizontal alignment assistance. When this type of system is used in combination with a vertical clamping system such as that described in the U.S. Pat. No. 4,901,380, one has an extremely efficient system that is also suitable for use with enclosures having tight corners.

Figure 7:
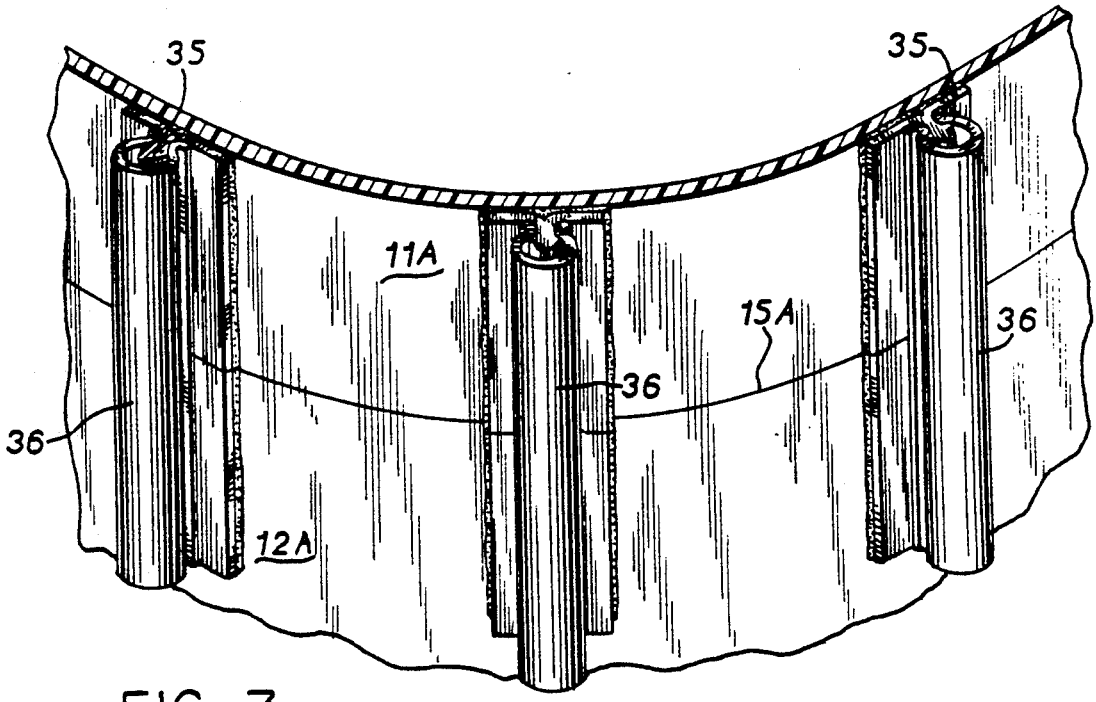
FIG. 7 is a perspective view of a portion of a second bathing enclosure showing how multiple webs and clips can be used.

The foregoing detailed description has been for the purpose of illustration. A number of modifications and changes may be made to these embodiments without departing from the spirit and scope of the invention. For example, as shown in FIG. 7, multiple clips can be used. Also, while a perfectly horizontal seam is shown, other "horizontally extending" seams can be used (e.g. have sloped or stepped seams).

I claim:

1. In a bathing enclosure of the type having a multipiece plumbing fixture wall structure having a first portion and a second portion, said first portion having walls with edges which can be substantially aligned with opposed edges of walls of the second portion so as to define a horizontally extending seam;

said enclosure also being of the type having means for restricting vertical movement of the portions relative to one another, the improvement comprising:

a first and a second alignment web, both of said webs being on an external side of the wall structure and having an outer vertically extending rib and an enlarged vertically extending head surface on said rib;

one of the webs is on the first wall structure portion and the other of the webs is on the second wall structure portion, said webs being both adjacent said seam such that the ribs and heads are aligned with one another so as to together form a vertically extending alignment bar; and a clip member extending across the seam and bearing against the side outer periphery of said ribs so as to restrict horizontal movement of the heads relative to one another.

2. The enclosure of claim 1, wherein the clip is in the form of tubular C-shaped member with flexible walls.

3. The enclosure of claim 2, wherein the C-shaped member has a hollow central section and feet.

4. The enclosure of claim 1, further comprising:

a first joining strip and a second joining strip, both of said joining strips being attached on an external side of the wall structure and having an inner attachment surface for abutment against said external side, an outer bulge with a slot therein, and an outer clamp abutment surface on said bulge;

the slots being formed so as to run along the joining strips;

one of said joining strips being affixed to the first wall structure portion and the other of said joining strips being affixed to the second wall structure portion;

said strip being both affixed adjacent said seam such that the slots face each other so as to define a tubular internal hollow;

a locator member positioned inside the hollow so as to assist alignment between the first and second portions; and means for clamping together the first and second enclosure portions by abutting against the clamp abutment surfaces so as to restrict vertical movement of the first portion relative to the second portion.

5. The enclosure of claim 1, wherein the webs are affixed adjacent a corner of the enclosure and are not integral with the wall portions.

* * * * *